US007480209B2

(12) United States Patent
Giles et al.

(10) Patent No.: US 7,480,209 B2
(45) Date of Patent: Jan. 20, 2009

(54) SUBMERSIBLE LOUDSPEAKER ASSEMBLY

(75) Inventors: Timothy James Giles, Spencerport, NY (US); Michael David Stevens, Avon, NY (US)

(73) Assignee: Harris Corporation, Melbourne, FL (US)

( * ) Notice: Subject to any disclaimer, the term of this patent is extended or adjusted under 35 U.S.C. 154(b) by 10 days.

(21) Appl. No.: 11/807,549

(22) Filed: May 29, 2007

(65) Prior Publication Data

US 2008/0298177 A1 Dec. 4, 2008

(51) Int. Cl.
*H04R 1/44* (2006.01)

(52) U.S. Cl. ..... 367/174; 381/189; 381/398

(58) Field of Classification Search ..... 367/163, 367/174; 381/184, 189, 345, 398
See application file for complete search history.

(56) References Cited

U.S. PATENT DOCUMENTS 2,517,138 A * 8/1950 Seabert ..... 367/174
4,081,628 A * 3/1978 Neusel ..... 381/189
4,872,148 A * 10/1989 Kirby et al. ..... 367/174
5,812,496 A * 9/1998 Peck ..... 367/174
6,396,769 B1 5/2002 Polany
6,545,948 B1 4/2003 Jiang
6,614,722 B2 9/2003 Polany et al.
6,954,405 B2 10/2005 Polany et al.

* cited by examiner

*Primary Examiner*—Ian J Lobo
(74) *Attorney, Agent, or Firm*—Harness, Dickey & Pierce, P.L.C.

(57) ABSTRACT

A submersible loudspeaker assembly is provided. The loudspeaker assembly includes: a housing; a loudspeaker enclosed within the housing; an external diaphragm disposed adjacent to the loudspeaker. The external diaphragm is acoustically transparent when subject to ambient air pressure, but configured to flex towards the loudspeaker when submerged in water.

15 Claims, 5 Drawing Sheets

SUBMERSIBLE LOUDSPEAKER ASSEMBLY

FIELD

The present disclosure relates generally to loudspeakers and, more particularly, to loudspeakers which may be submerged in water.

BACKGROUND

Tactical radios for military applications must continue to meet increased reliability requirements. One evolving requirement is that tactical radios be submersible in water. While the radio needs to operate with high intelligibility and volume on the battlefield, it is not required to function underwater. However, the loudspeaker and/or microphone interface of the radio provides a point susceptible to damage when the radio is submerged in water. Therefore, it is desirable to develop a cost effective and reliable loudspeaker assembly which may be submerged in water.

The statements in this section merely provide background information related to the present disclosure and may not constitute prior art.

SUMMARY

A submersible loudspeaker assembly is provided. The loudspeaker assembly includes: a housing; a loudspeaker enclosed within the housing; an external diaphragm disposed adjacent to the loudspeaker. The external diaphragm is acoustically transparent when subject to ambient air pressure, but configured to flex towards the loudspeaker when submerged in water.

In another aspect of the disclosure, the loudspeaker assembly is integrated into a radio. The radio includes a housing having a recessed portion formed in an external surface thereof. The loudspeaker assembly is encased within the housing adjacent to the recessed portion. An external diaphragm encloses the recessed portion of the housing, but is in spaced relation to the external surface of the housing, thereby allowing the external diaphragm to vibrate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
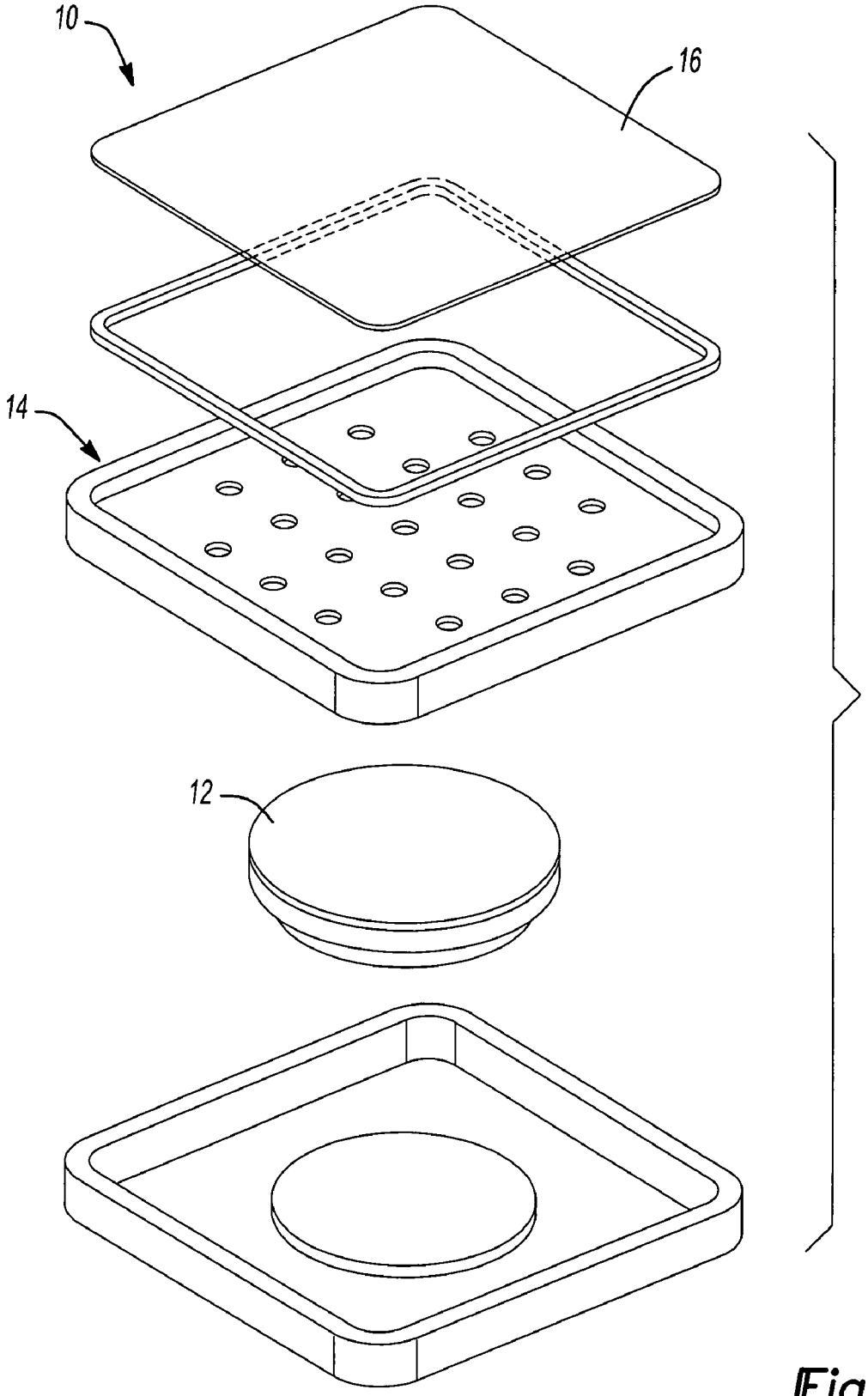
FIG. 1 is a perspective view of an exemplary loudspeaker assembly which may be submerged in water.
Figure 2:
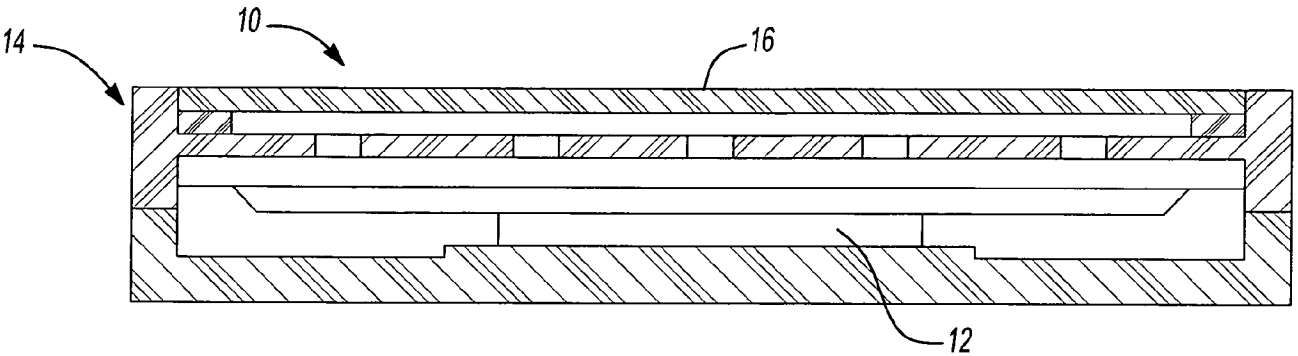
FIG. 2 is a cross-sectional view of the exemplary loudspeaker assembly.

FIGS. 1 and 2 illustrate an exemplary loudspeaker assembly 10 which may be submerged in water. The loudspeaker assembly 10 is generally comprised of a loudspeaker 12; a housing 14 for the speaker; and an external diaphragm 16 disposed adjacent to the loudspeaker. The external diaphragm 16 allows audio frequencies to pass when the assembly is not submerged in water but functions to limit the pressure exerted on the speaker when the assembly is submerged in water in a manner further described below.

The loudspeaker has a conventional construct, including a diaphragm for emitting sound. Any such loudspeaker may be used in the loudspeaker assembly.

In the exemplary assembly, the loudspeaker is enclosed within the housing. Multiple holes are formed into the housing adjacent to the diagram of the loudspeaker to allow the sound from the speaker to pass. It is contemplated that the remainder of the housing provides a watertight enclosure for the speaker. In an alternative assembly, the housing may only encase a portion of the loudspeaker, including the diaphragm of the loudspeaker. In this case, the unenclosed portion of the loudspeaker is preferable watertight.

When the speaker assembly is not submerged in water, the external diaphragm is designed to vibrate in response to sound waves from the loudspeaker. In the exemplary assembly, the external diaphragm is a sheet of flexible material fixed along its periphery to the housing. Different types of materials may be used for the external diaphragm to achieve different acoustic performance. The external diaphragm is fixed to the loudspeaker housing in a manner which leaves an air gap between the external diaphragm and the housing, thereby permitting the external diaphragm to vibrate. In this way, the external diaphragm passes the sound from the loudspeaker (i.e., acoustically transparent) when subject to ambient air pressure.

When the speaker assembly is submerged in water, the pressure experienced by the assembly increases. However, the diaphragm of the loudspeaker is designed to withstand small amounts of pressure experienced at shallow depths, thereby maintaining the integrity of the assembly structure. It is noteworthy that the pressure exerted on the external diaphragm at shallow depths (e.g., a few meters) does not deform the external diaphragm.

The pressure experienced by the assembly increases as the assembly is submerged deeper into the water. For example, the speaker assembly experiences about 30 p.s.i of pressure when the assembly is submerged in 20 meters of water. Without the use of an external diaphragm, this amount of pressure would be applied to the diaphragm of the loudspeaker. The diaphragm of most conventional speakers would rupture when subject to this amount of pressure, thereby rendering the speaker inoperable as well as allowing water to penetrate within the device that contains the speaker.

Figure 3:
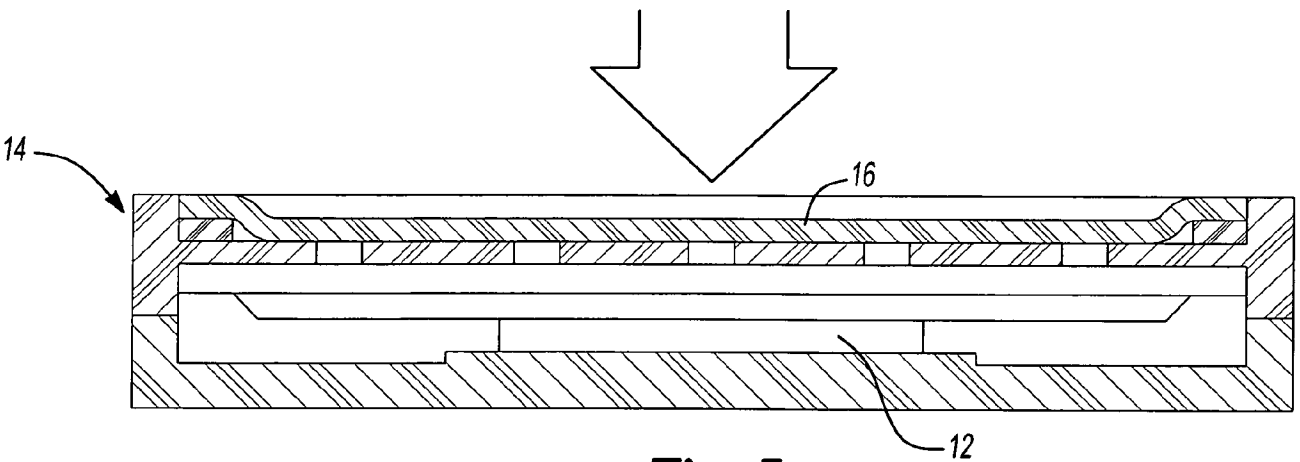
FIG. 3 is a cross-section view of the exemplary loudspeaker when submerged in water.
Figure 4:
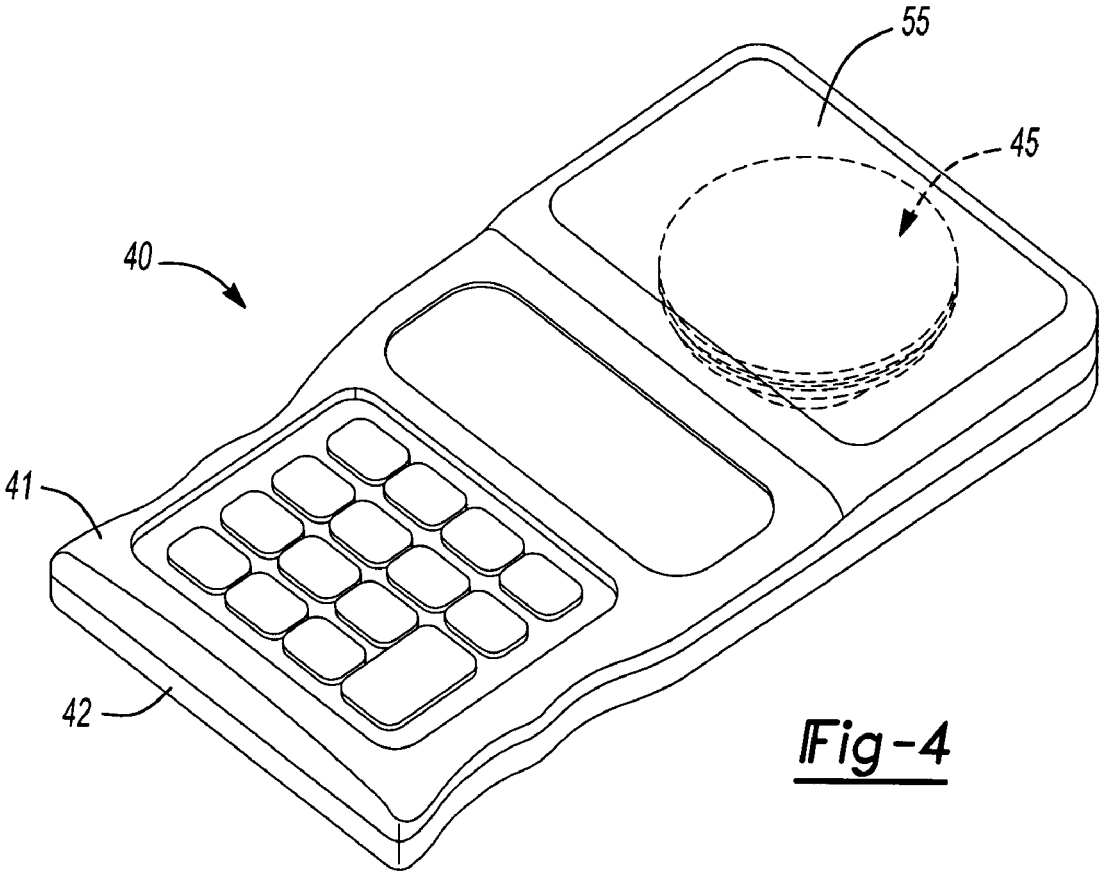
FIG. 4 is a perspective view of an exemplary tactical radio which employs a submersible loudspeaker assembly.
Figure 5:
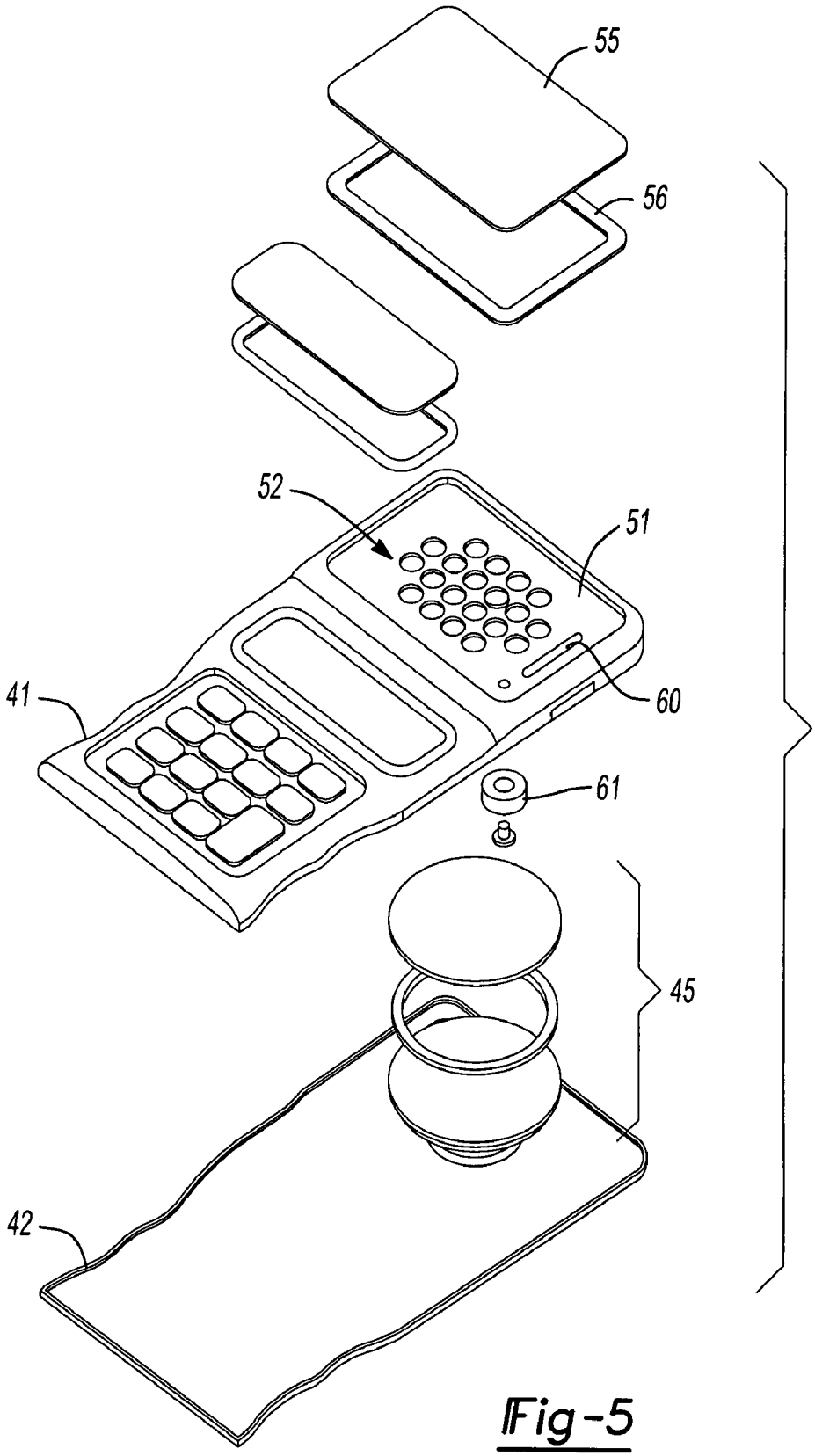
FIG. 5 is an exploded view of the tactical radio.
Figure 6:
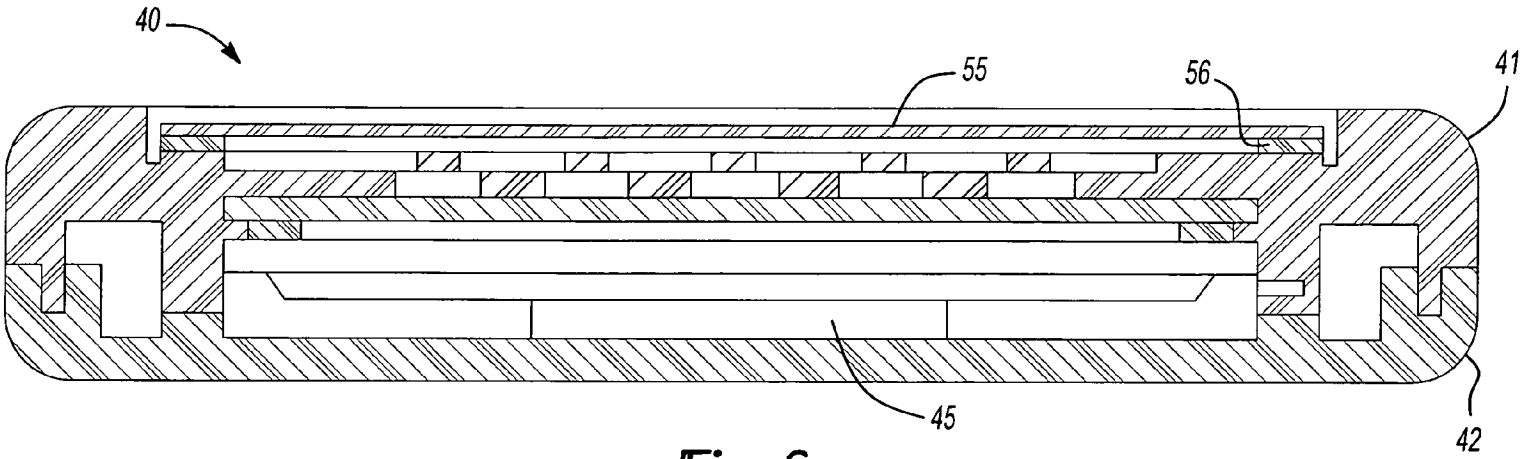
FIG. 6 is a cross-sectional view of the tactical radio.

In contrast, the external diaphragm of the proposed speaker assembly is configured to minimize the pressure exerted on the diaphragm of the loudspeaker. When the pressure exerted on the external diaphragm exceeds some threshold, the external diaphragm flexes inward towards the housing as shown in FIG. 3. As a result, the pressure exerted on the external diaphragm is absorbed by the housing and thus not experienced by the loudspeaker. It is understood that the external diaphragm is preferably designed to flex (without rupturing) at a pressure which exceeds the pressure that can be withstood by the loudspeaker. While reference is made to submerging the assembly in 20 meters of water, it is further understood that the external diaphragm may be designed to function at different pressure levels.

FIGS. 4-7 illustrate an exemplary tactical radio 40 which employs a submersible loudspeaker assembly. Exemplary tactical radios may include a handheld radio or a manpack radio from the Falcon III series of radio products commercially available from Harris Corporation. Other types of radios are also contemplated by this disclosure. Moreover, this disclosure contemplates other types of communication device which employ a loudspeaker.

A housing for the radio is formed by a two-piece casing 41, 42 which couples together to provide a watertight enclosure for the radio components. A loudspeaker 45 is amongst the components enclosed in the housing. The loudspeaker 45 is positioned adjacent to a recessed portion 51 formed in the faceplate 41 of the radio. The recessed portion 51 includes a plurality of holes 52 which allow the sound from the loudspeaker to be heard outside of the housing. Other conventional radio components (not shown) may also be enclosed in the housing and need not be discuss any further herein.

An external diaphragm 55 encloses the recessed portion of the housing. In the exemplary embodiment, the external diaphragm 55 is a rectangular plate formed of a polycarbonate material. It is readily understood that the external diaphragm 55 may be configured in different shapes and be comprised of different materials. However, in this exemplary application, the material of the external diaphragm needs to meet the reliability requirements of an external surface of a tactical radio.

The external diaphragm 55 is preferably sized to fit within the recessed portion of the housing. In the exemplary embodiment, the external diaphragm 55 is fixed within the recess using an adhesive tape 56, such as VHB adhesive tape commercially available from 3M Corporation. The adhesive tape 56 is placed along the periphery of the external diaphragm, thereby forming a small air gap 58 between the external diaphragm 55 and the faceplate 41 of the radio. It is contemplated that other means may be employed to fix the external diaphragm within the recess. This arrangement allows the external diaphragm to vibrate and thus pass the sound from the loudspeaker. In addition, the recess enables the external diaphragm to be flush mounted with the remainder of the faceplate.

In the exemplary embodiment, one or more additional slits 60 may be formed in the area of the faceplate positioned between the external diagraph and the enclosure of the housing. Because the air gap is rather small, the slits enable the temperature in the gap to equalize with the temperature of the remaining interior of the housing. When subject to extreme temperature conditions, these slits prevent a build up of pressure which may cause the external diaphragm to buckle.

Figure 7:
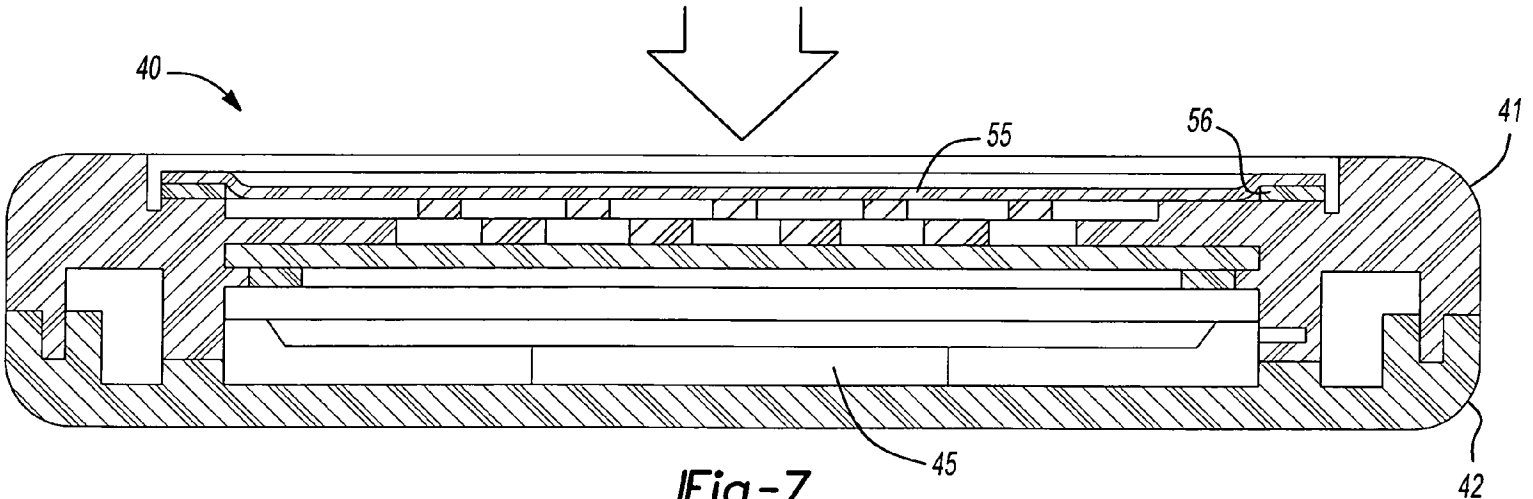
FIG. 7 is a cross-section view of the tactical radio when submerged in water.

When the radio is submerged in water or otherwise subject to sufficient external pressure, the external diaphragm flexes inward towards the housing as shown in FIG. 7. The holes in the recessed portion of the faceplate are sized large enough to pass the sound from the loudspeaker but small enough that the external diaphragm does not depress into the holes when pressed against the recessed portion of the faceplate.

A microphone 61 may also be positioned behind the external diaphragm. In this way, the microphone is protected in a similar manner from the any increased pressure when the radio is submerged in water.

The above description is merely exemplary in nature and is not intended to limit the present disclosure, application, or uses.

What is claimed is:

1. A submersible loudspeaker assembly, comprising:

a loudspeaker having a diaphragm for emitting sound;

a housing encasing at least the diaphragm of the loudspeaker; and an external diaphragm encloses a recessed portion of the housing in an external surface thereof adjacent to the loudspeaker and is fixed to the housing along a periphery of the external diaphragm, wherein the external diaphragm within the periphery is in spaced relation to the housing but configured to flex towards the loudspeaker and engage an external surface of the housing when subject to pressure which exceeds a defined threshold.

2. The loudspeaker assembly of claim 1 wherein the housing include a plurality of holes adjacent to the loudspeaker, thereby allowing sound from the loudspeaker to pass therethrough.

3. The loudspeaker assembly of claim 1 wherein the external diaphragm forms a watertight seal with the housing.

4. The loudspeaker assembly of claim 1 further comprises a microphone encased within the housing and positioned adjacent to the external diaphragm.

5. A submersible loudspeaker assembly, comprising:

a housing;

a loudspeaker enclosed within the housing, the housing having a recessed portion formed in an external surface thereof adjacent to the loudspeaker;

an external diaphragm disposed adjacent to the loudspeaker and enclosing the recessed portion of the housing, the external diaphragm engaging the housing along a periphery of the external diaphragm and in spaced relation with the housing within the periphery of the external diaphragm;

wherein the external diaphragm is acoustically transparent when subject to ambient air pressure and configured to flex towards the loudspeaker and engage an external surface of the housing when subject to pressure which substantially exceeds ambient air pressure.

6. The loudspeaker assembly of claim 5 wherein the housing provides a plurality of holes adjacent to the loudspeaker, thereby allowing sound from the loudspeaker to pass therethrough.

7. The loudspeaker assembly of claim 5 wherein the external diaphragm forms a watertight seal with the housing.

8. The loudspeaker assembly of claim 5 further comprises a microphone encased within the housing and positioned adjacent to the external diaphragm.

9. A radio, comprising:

a housing;

a loudspeaker encased in the housing, the housing having a recessed portion formed in an external surface thereof adjacent to the loudspeaker and a plurality of holes formed in the recessed portion of the housing; and an external diaphragm enclosing the recessed portion of the housing and in spaced relation to the external surface of the housing, thereby allowing the external diaphragm to vibrate.

10. The radio of claim 9 wherein the external diaphragm is configured to engage an external surface of the housing when flexed towards the loudspeaker.

11. The radio of claim 9 where the external diaphragm is comprised of a polycarbonate material.

12. The radio of claim 9 wherein the external diaphragm is flush mounted with external surface of the housing.

13. The radio of claim 9 wherein the external diaphragm is fixed with the recess portion using an adhesive tape.

14. The radio of claim 9 wherein the external diaphragm forms a watertight seal with the housing.

15. The radio of claim 9 further comprises a microphone encased within the housing and positioned adjacent to the external diaphragm.

* * * * *